US006213118B1

(12) United States Patent
Adcock et al.

(10) Patent No.: US 6,213,118 B1
(45) Date of Patent: Apr. 10, 2001

(54) OVEN VENT TUBE

(75) Inventors: Darrell Adcock, Hixson; Kevin R. Taylor, Madisonville; Tracy D. Watson, Athens, all of TN (US)

(73) Assignee: Mills Products, Inc., Brentwood, TN (US)

( * ) Notice: Subject to any disclaimer, the term of this patent is extended or adjusted under 35 U.S.C. 154(b) by 0 days.

(21) Appl. No.: 09/620,798

(22) Filed: Jul. 21, 2000

(51) Int. Cl.[7] ..... F23J 11/00; F23J 15/00

(52) U.S. Cl. ..... 126/312; 126/307 R; 110/203; 110/210; 422/179

(58) Field of Search ..... 126/312, 289, 126/290, 307 R, 19, 20 R; 422/177, 179, 180, 221, 222; 60/299, 295; 110/203–210; 431/7, 329, 326, 328, 268

(56) References Cited

U.S. PATENT DOCUMENTS 3,984,207 * 10/1976 Abthoff et al. ..... 422/179
4,158,037 * 6/1979 Ayoma ..... 422/179
4,248,833 * 2/1981 Aoyami ..... 422/179
4,373,452 * 2/1983 Van Dewoestine ..... 110/203
4,476,852 * 10/1984 Lee et al. ..... 126/289
4,550,668 * 11/1985 Piontkowski ..... 110/210
4,643,862 * 2/1987 Callahan ..... 110/203
4,667,386 * 5/1987 Enomoto et al. ..... 422/177

* cited by examiner

*Primary Examiner*—James C. Yeung
(74) *Attorney, Agent, or Firm*—Reising, Ethington, Barnes, Kisselle, Learman & McCulloch, P.C.

(57) ABSTRACT

A vent tube has an open end adapted to communicate with an oven chamber. A catalyst is retained in the vent tube by two sets of abutments. In one embodiment, the abutments are in the form of tabs. The tabs are lanced from the wall of the vent tube and slant inwardly. The set of tabs nearer to the open end of the vent tube will flex outwardly to permit the catalyst to be inserted through the open end of the vent tube into position between the two sets of tabs. A wall of the oven chamber has an extruded hole over which the open end of the vent tube is fitted. In another embodiment, the abutments are in the form of dimples formed in the wall of the vent tube.

10 Claims, 1 Drawing Sheet

OVEN VENT TUBE

FIELD OF THE INVENTION

This invention relates generally to vent tube assemblies for ovens including commercial cooking ranges.

BACKGROUND OF THE INVENTION

Currently, oven vent tube assemblies are made in two parts. A flanged tube is inserted through a hole in a wall of the oven chamber from the inside. The flange is secured to the wall with screws. The vent tube with a catalyst therein, is then placed over the flanged tube.

SUMMARY OF THE INVENTION

In accordance with the present invention, an integrated design is provided in which the flanged tube is eliminated. The vent tube is fitted over an extruded hole in the wall of the oven chamber. The catalyst is secured in the vent tube preferably by three or more abutments above and below the catalyst. The catalyst may be installed by inserting it into an open end of the vent tube to a position between the two sets of abutments.

The abutments may be in the form of flexible tabs lanced from the wall of the vent tube and bent toward the inside of the vent tube. The tabs nearest the open end of the tube may be deformed inwardly before or after insertion of the catalyst, but if deformed inwardly before insertion of the catalyst, the catalyst would have to press against and flex the tabs outwardly during insertion, risking damage to the catalyst.

Alternatively, the abutments may be in the form of dimples pressed from the wall of the vent tube toward the inside of the vent tube. The dimples would be flexible. The dimples nearest the open end of the tube maybe formed in the wall of the tube before or after insertion of the catalyst, but, as with the tabs, if formed in the wall of the tube before insertion of the catalyst, the catalyst would have to press against and flex outwardly or flatten the dimples during insertion, risking damage to the catalyst.

The present invention is a simple design which eliminates the flanged tube and is easy to manufacture and install. It is also much less expensive than the current design.

One object of this invention is to provide an oven vent tube having the foregoing features and capabilities.

Another object of the invention is to provide an oven vent tube which is rugged and durable in use, is relatively inexpensive, and can be easily manufactured and installed.

These and other objects, features and advantages of the invention will become more apparent as the following description proceeds, especially when considered with the accompanying claims and drawings.

DETAILED DESCRIPTION OF THE PREFERRED EMBODIMENT

Figure 1:
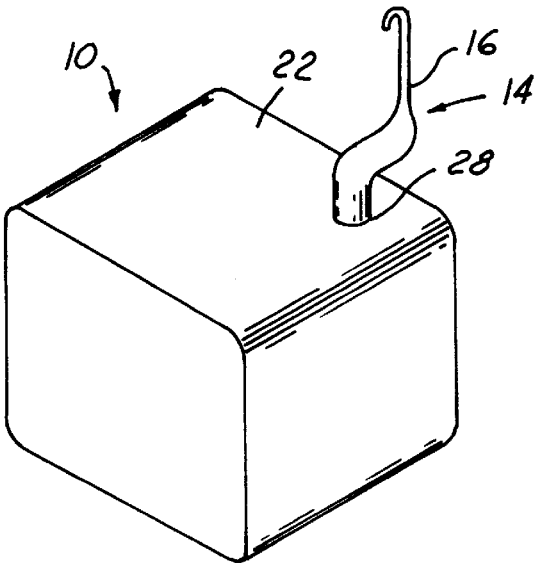
FIG. 1 is an elevational view showing an oven and a vent tube extending from the oven chamber, constructed in accordance with the invention.

There is shown in FIGS. 1–4 the drawings an oven 10 which may, for example, be part of a commercial cooking range. The oven 10 has a chamber 12 which is vented by a vent tube assembly 14.

The vent tube assembly 14 includes an elongated open-ended vent tube 16 and a catalyst body 18 within a cylindrical inner end portion 20 of the vent tube. The catalyst body 18 is made of a typical catalyst material, such as a suitable ceramic, and is intended to entrap smoke and generally clear the air before exhausting it to the atmosphere. The catalyst is especially useful during an oven cleaning cycle.

The top wall 22 of the oven chamber 12 has a hole 24 defined by an annular, outwardly flared, marginal edge portion 26 providing what is sometimes referred to as an extruded hole. The circular inner end 28 of the vent tube is slipped over the marginal edge portion 26 of the extruded hole preferably with a friction fit.

The catalyst body 18 is located within the inner end portion of the vent tube in an operative position by two sets of abutments in the form of flexible tabs 30 and 32 spaced axially from one another. The tabs 30 are arranged in an equal, angularly spaced relationship around the central axis of the inner end portion 20 of the vent tube. The tabs 30, in their natural, free-state condition, slant radially inwardly in an axially outward direction, that is in a direction away from the oven chamber.

The tabs 32 are arranged in equal, angularly spaced relation around the central axis of the inner end portion 20 of the vent tube and are deformed so that, in their natural, free-state condition, slant radially inwardly in an axially inward direction, that is in a direction toward the oven chamber.

Preferably there are three or more tabs in each set. The tabs 30 and 32 are lanced from the wall of the vent tube and hence integral with the vent tube.

Before the vent tube is fitted over the extruded hole 24, the catalyst body 18 is installed in the vent tube. The catalyst body is inserted in the inner end 28 of the vent tube. If both sets of tabs are bent inwardly to the positions shown before insertion of the catalyst body, then with some small amount of pressure, the catalyst body will cam past the set of tabs 30 closer to the inner end of the vent tube and into contact with the set of tabs 32, at which time the tabs 30 snap back so that the catalyst body is captured or trapped between the two sets of tabs in an operative position. After the catalyst body is properly installed, the inner end 28 of the vent tube is placed over the marginal edge portion 26 of the extruded hole as previously described.

The catalyst body 18 is typically made of a relatively rigid material and is quite capable of camming past the set of tabs 30 during installation without being damaged. However, if the set of tabs 30 are deformed inwardly to the position shown only after insertion of the catalyst body, the catalyst body would not have to press against and flex the tabs 30 outwardly during insertion, thereby avoiding the possibility of damaging the catalyst body.

Figure 5:
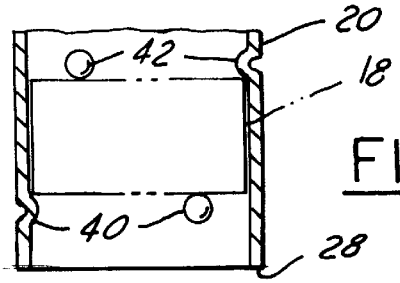
FIG. 5 is a view similar to FIG. 3, but shows a modification.

FIG. 5 shows a modification of the invention in which the abutments for locating the catalyst body in the vent tube are in the form of flexible dimples 40 and 42 spaced axially from one another the same distance as tabs 30 and 32 in the first embodiment. The dimples 40 and 42 are arranged in the same equal, angularly spaced relationship around the central axis of the inner end portion 20 of the vent tube as the flexible tabs 30 and 32 of the first embodiment. The dimples are deformed from the wall of the vent tube so that in their natural, free state condition, they project radially inwardly.

Before the vent tube is fitted over the extruded hole 24, the catalyst body 18 is installed in the vent tube. The catalyst body is inserted in the open end 28 of the vent tube. If both sets of dimples are formed before insertion of the catalyst body, then, with some small amount of pressure, the catalyst will cam past the set of dimples 40 which are closer to inner end of the vent tube and into contact with the set of dimples 42, at which time the dimples 40 will snap back to their illustrated position such that the catalyst body is captured or trapped between the two sets of dimples in an operative position.

However, if the set of dimples 40 are deformed inwardly to the position shown only after insertion of the catalyst body, the catalyst body would not have to press against and flex or flatten the dimples 40 outwardly during insertion, thereby avoiding the possibility of damaging the catalyst body.

Figure 6:
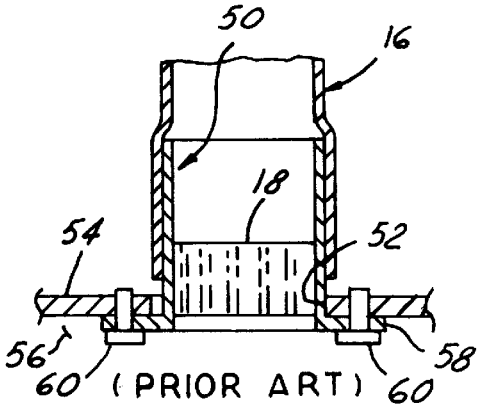
FIG. 6 is a sectional view of a prior art construction.
Figure 3:
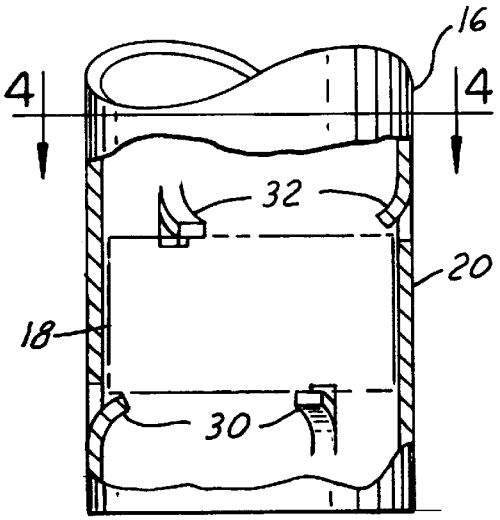
FIG. 3 is an elevational view, with parts in section, of a portion of the vent tube.
Figure 2:
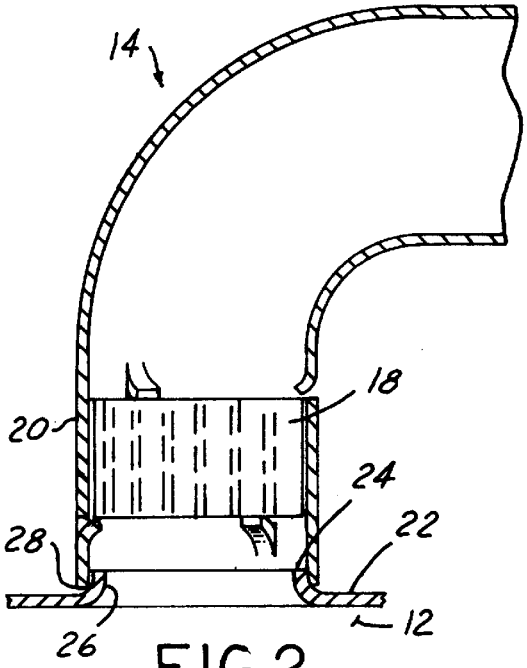
FIG. 2 is an enlarged sectional view of a portion of the vent tube, the catalyst, and a portion of the top wall of the oven.
Figure 4:
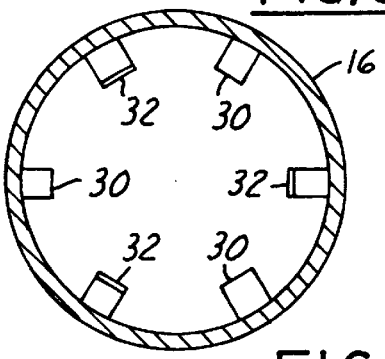
FIG. 4 is a sectional view taken on the line —4 in FIG. 3.

FIG. 6 shows an example of a prior art construction in which, in addition to the vent tube 16', a flanged tube 50 is required. The flanged tube 50 is inserted through a hole 52 in a wall 54 of the oven chamber 56 from the inside, bringing the radial flange 58 of the tube 50 up against the inner surface of the wall 54. The flange 58 is secured to the wall 54 with screws 60. The catalyst body 18 is secured within the vent tube as by adhesive. The inner end of the vent tube is then sleeved over the flanged tube 50. This is a two-part vent tube assembly consisting of the vent tube and a flanged tube. The flanged tube must be secured to the wall of the oven chamber by screws inserted from inside the oven chamber.

What is claimed is:

1. An oven vent tube assembly comprising:

an elongated vent tube having an open inner end adapted to communicate with an oven chamber, a catalyst body in said vent tube, and means for retaining said catalyst body in an operative position in said vent tube including first abutment means adjacent said open end and second abutment means more remote from said open end than said first abutment means, said catalyst body being captured in said operative position between said first and second abutment means, said first abutment means being yieldable to permit said catalyst body, when introduced into said open inner end of said vent tube, to be moved past said first abutment means to said operative position.

2. An oven vent tube assembly as defined in claim 1, wherein said first abutment means includes an annular series of circumferentially spaced flexible tabs.

3. An oven vent tube assembly as defined in claim 2, wherein said tabs are integrally connected to the wall of said vent tube and slant radially inwardly in a direction away from said open end.

4. An oven vent tube assembly as defined in claim 1, wherein said first and second abutment means each includes an annular series of circumferentially spaced flexible tabs integrally connected to and lanced from a wall of said vent tube.

5. An oven vent tube assembly as defined in claim 4, wherein the tabs of said first abutment means slant radially inwardly in a direction away from said open end, and the tabs of said second abutment means slant radially inwardly in a direction toward said open end.

6. An oven vent tube assembly as defined in claim 5, and further including a wall of said oven chamber having a hole communicating with said oven chamber, said hole being defined by an outwardly flared marginal edge portion of the wall, and said inner end of said tube being fitted over the outwardly flared marginal edge portion of the wall.

7. An oven vent tube assembly as defined in claim 1, wherein said first abutment means includes an annular series of circumferentially spaced flexible dimples.

8. An oven vent tube assembly as defined in claim 2, wherein said dimples are formed integrally with the wall of the vent tube and project radially inwardly.

9. An oven vent tube assembly as defined in claim 1, wherein said first and second abutment means each includes an annular series of circumferentially spaced flexible dimples formed integrally with the wall of the vent tube and projecting radially inwardly.

10. An oven vent tube assembly as defined in claim 9, and further including a wall of said oven chamber having a hole communicating with said oven chamber, said hole being defined by an outwardly flared marginal edge portion of the wall, and said inner end of said tube being fitted over the outwardly flared marginal edge portion of the wall.

* * * * *